US005313759A

United States Patent [19]

Chase, III

[11] Patent Number: 5,313,759

[45] Date of Patent: May 24, 1994

[54] CLEANROOM CEILING SYSTEM

[76] Inventor: Francis H. Chase, III, 123 Winnisimet Dr., Tiverton, R.I. 02878

[21] Appl. No.: 809,969

[22] Filed: Dec. 18, 1991

[51] Int. Cl.[5] ..... E06B 3/54

[52] U.S. Cl. ..... 52/506.06; 52/39

[58] Field of Search ..... 52/484, 39, 483, 584, 52/355, 385, 387

[56] References Cited

U.S. PATENT DOCUMENTS

| | | | |
|---|---|---|---|
| 3,067,323 | 12/1962 | Kember | 52/484 X |
| 3,782,082 | 1/1974 | Smith et al. | 55/494 |
| 4,570,391 | 2/1986 | Quante et al. | 52/39 |
| 4,608,066 | 8/1986 | Cadwell, Jr. | 55/385 |
| 4,619,086 | 10/1986 | Naka | 52/484 X |
| 4,671,811 | 6/1987 | Cadwell, Jr. et al. . | |

FOREIGN PATENT DOCUMENTS

| | | | |
|---|---|---|---|
| 1053166 | 3/1959 | Fed. Rep. of Germany | 52/484 |
| 3247506 | 7/1984 | Fed. Rep. of Germany | 52/484 |

OTHER PUBLICATIONS

Submittal G-2x1.5, American Air Filter, Environmental Control Division, P.O. Box 35690, Louisville, Ky. 40232-5690, Feb. 1986.

Brochure, American Air Filter, Environmental Control Division, P.O. Box 35690, Louisville, Ky. 40232-5690.

Submittal, G-BU, American Air Filter, Environmental Control Division, P.O. Box 35690, Louisville, Ky. 40232-5690, Feb. 1986.

Brochure, Comp-Aire Part No. 0027132, Comp-Aire Systems, 4160-44th Street S.E., Grand Rapids, Mich. 49508.

*Primary Examiner*—Carl D. Friedman

*Assistant Examiner*—Creighton Smith

*Attorney, Agent, or Firm*—Cesari and McKenna

[57] ABSTRACT

A suspended ceiling system for use in a cleanroom or other application incorporates a framework formed from lengthwise and crosswise frame members which form open areas for mounting components such as air filter modules, light fixture panels, blank panels and the like. The ceiling system includes splice members for connecting the frame members together and clamps for securing the components to the frame members. Suspension members, which preferably engage corresponding fastening members disposed within the frame members, suspend the framework from the ceiling, defining an interior space above the framework. Substantial loads, such as utilities, robotics and wall partitions may be suspended from the framework by clips that engage with the frame members.

14 Claims, 7 Drawing Sheets

CLEANROOM CEILING SYSTEM

BACKGROUND OF THE INVENTION

A. Field of the Invention

The present invention relates to a suspended ceiling system for use in a cleanroom or other similar applications, and, more specifically, to a suspended ceiling system capable of supporting substantial loads either above or below the plane of the ceiling.

B. Description of the Related Prior Art

Precision manufacturing and assembly operations, particularly in the fields of semiconductors, aerospace, bioscience, pharmaceuticals, medicine, and food processing, are usually conducted in a controlled, contaminant-free work area, called a "cleanroom." A cleanroom is a specially constructed, enclosed area, environmentally controlled with respect to airborne particles, temperature, humidity, air flow patterns, etc.

A cleanroom conventionally includes a ceiling system for supply air and a raised floor system and/or side wall return air system. The ceiling system admits filtered air into the room, while the floor system or side wall grilles provide return air from the room in a closed loop arrangement. In some ceiling systems, a suspended framework supports air filters, blank panels, and lighting and defines an interior space between itself and the building structure to which it is attached. A supply duct or plenum provides temperature and humidity-conditioned air in the interstitial space above the framework. The air is delivered through filters to the room below.

In conventional cleanrooms, the utilities which sustain the manufacturing process are housed in separate "core areas" or above the ceiling. The utilities such as process piping, gases, air and vacuum lines are usually introduced into the cleanroom through openings in the walls or penetrations through the ceiling. Conventionally, a core area is disposed between two cleanrooms and thus provides utilities to both.

However, this conventional layout presents several problems. First, core areas occupy floor space which might otherwise be used as additional cleanroom space. Second, changing the size of a cleanroom is a cumbersome and costly ordeal which involves not merely relocating walls, but the removal and reinstallation of all of the utility equipment in an adjacent core area, especially when utilities and partitions penetrate the ceiling.

Conventional ceiling systems, however, are generally designed to support relatively light loads (e.g. air filters, blank panels, lights), typically on the order of a few pounds per square foot. Consequently, such systems are structurally unsuitable for bearing substantial loads such as process pipes, gas lines, air lines, vacuum lines, or a human technician who must service or repair equipment. Further, such ceiling systems are not suitable for directly supporting substantial loads suspended downward into the cleanroom. Finally, many conventional ceiling systems severely restrict where a rod or other suspension member may be attached to the framework for suspending it from the building structure.

DESCRIPTION OF THE INVENTION

A. Summary of the Invention

It is a principal object of this invention to provide a suspended ceiling system which permits construction of a cleanroom without necessarily predetermining floor space configuration for fixed clean or core areas.

Another object of this invention is to provide a suspended ceiling system which eliminates the need for load-bearing partitions.

Another object of this invention is to provide a suspended ceiling system which permits reconfiguration of a cleanroom without substantial rerouting of utilities.

Another object of this invention is to provide a suspended ceiling system which is capable of supporting substantial loads either above or below the plane of the ceiling.

Another object of this invention is to provide a suspended ceiling system which will support a substantial load placed at practically any location on the system.

Another object of this invention is to provide a suspended ceiling system which allows suspension members to be positioned at substantially any location.

Another object of this invention is to provide a suspended ceiling system which exhibits, under applied loads, a sufficiently small deflection characteristic such that airtight seals surrounding air filters and other components remain intact even when the system is subjected to significant dead loads and live loads such as a human technician.

Another object of this invention is to provide a suspended ceiling system having a substantially increased load-bearing capacity.

Briefly, a cleanroom suspended ceiling system embodying the invention incorporates a framework formed from rigid lengthwise and crosswise frame members. Open areas in the framework are shaped to accommodate air filters, light fixtures or other equipment. The cross-section of each frame member is an inverted-T shape. A U-shaped slot, extending along the length of the vertical segment of the T, has threaded sides for engaging suspension members. Since the U-shaped slot extends everywhere along the framework, a suspension member may be connected at practically any location on the framework.

In accordance with the present invention, a fastening member may be disposed within a frame member at practically any location for engaging a suspension member which is inserted into the U-shaped slot. Such fastening members provide a substantial increase in the load-bearing capacity of the framework, typically, on the order of 6–7 times that of conventional suspended ceiling systems. The framework supports these greater loads with sufficiently small deflection of the frame members so that filters and other components that are sealed in an airtight manner are not unseated.

The greatly improved load-bearing capacity of the present invention is achieved at a low cost and provides numerous advantages. First, it permits construction of a cleanroom without necessarily dedicating floor space for core area functions because all of the core area utilities may be supported overhead by the ceiling system. Thus, should reconfiguration of the cleanroom be necessary, this may be achieved without massive rerouting of utilities.

Second, the increased load-bearing capacity and small deflection under load allows a human technician to walk freely on top of the framework. This is particularly advantageous for installation, balancing and maintenance of the utilities, air filters and other components.

Third, equipment such as robotics, process piping, conveyor belts and partitions, may be suspended from the framework into the cleanroom. Since the framework itself is intended to bear practically all loads, regardless of whether they are positioned above or below the framework equipment may generally be placed anywhere on the framework and need not be aligned with nor attached to a suspension member. This adds much flexibility to the manufacturing or assembly operations conducted within the cleanroom.

B. BRIEF DESCRIPTION OF THE DRAWINGS

The foregoing discussion will be understood more readily from the following detailed description of the invention, when taken in conjunction with the accompanying drawings, in which.

C. DETAILED DESCRIPTION OF AN ILLUSTRATIVE EMBODIMENT

Figure 1:
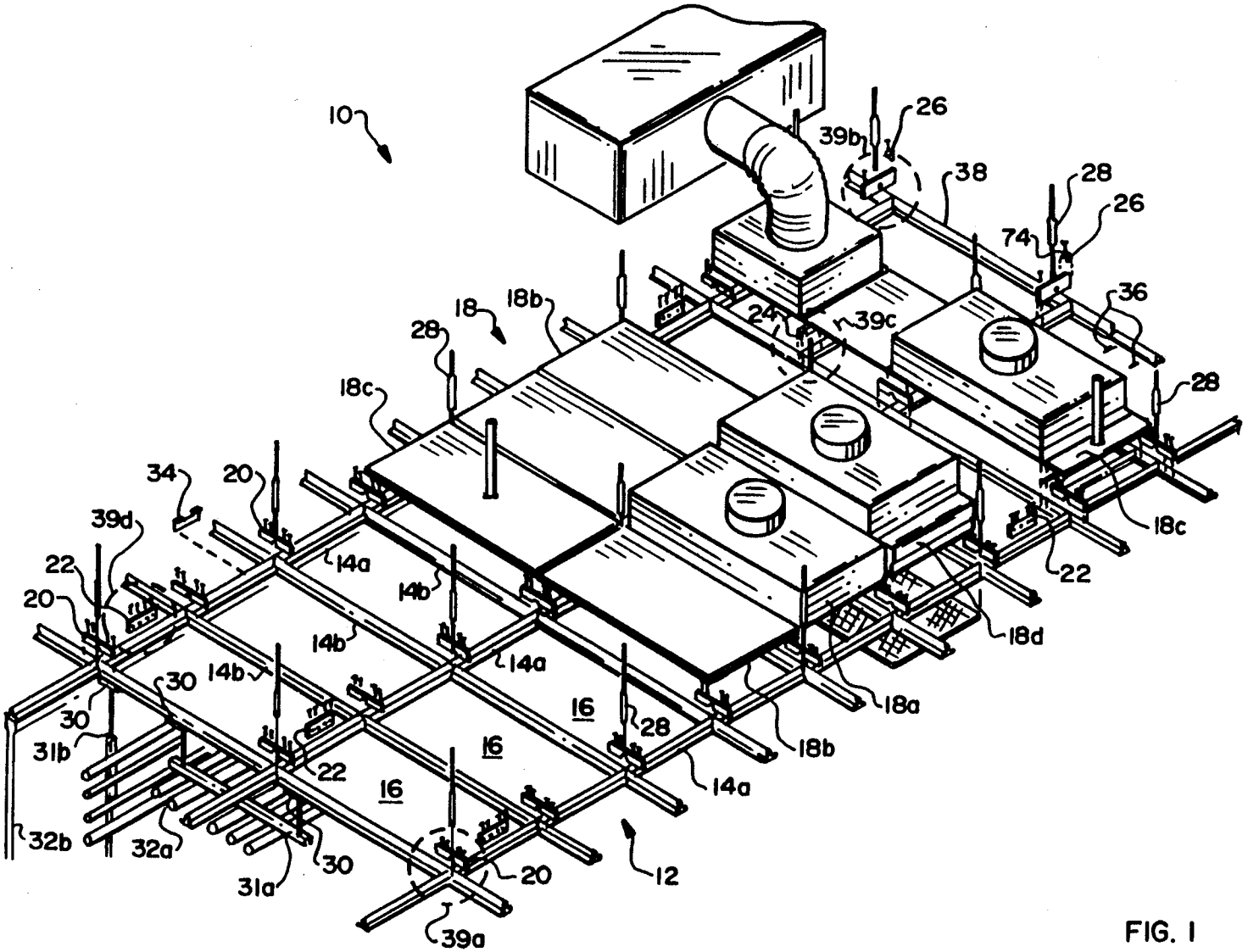
FIG. 1 is a perspective view of a suspended ceiling system which is constructed in accordance with a preferred embodiment of the present invention.

In FIG. 1., reference numeral 10 generally indicates a ceiling system which may be suspended from a building structure (not shown). Preferably, a framework 12 is constructed from frame members 14 which are arranged such that lengthwise frame members **14*a* and crosswise frame members 14*b* form open rectangular areas 16. The areas 16 are adapted to receive various components 18 such as air filter modules 18*a*, blank panels 18*b*, fire sprinklers 18*c*, light fixtures 18*d* and other components (not shown). The frame members 14** are preferably arranged to form a frame, but the members may be placed in a different arrangement to meet the requirements of different applications.

Splice members, such as a cross splice 20, a main splice 22, a modified cross splice 24 and a bracket 26, secure the frame members 14 together. The splice members 20, 22, 24 and 26 secure the various intersections within the framework. The cross splice 20 is used to secure the frame members 14 at a cross intersection **39*a*. At a T intersection 39*b* of two frame members 14, such as are found along the perimeter of the framework 12, the main splice 22 and the bracket 26 secure the members 14 together. At other T intersections 39*c* within the framework, but not at the perimeter, the modified cross splice 24 is used to secure the members 14 together. The main splice 22 is also used to join two colinear members 14 whose ends abut, as indicated by reference numeral 39*d*. The main splice 22 can be installed either by sliding it laterally onto the frame member 14** or by snapping it onto the frame member from above.

Suspension members 28, whose upper ends may be secured to the building structure by any of a number of conventional fasteners (not shown), are attached to desired points of the framework 12. Utility clips 30 are adapted to engage with the bottom portions of the frame members 14 and, possibly in combination with load suspension members **31*a* or 31*b* or other suspension means (not shown), to suspend loads such as pipes 32*a* from the framework 12. Partition clips 34, which are adapted to engage with the bottom portions of the frame members 14, operate to suspend a wall partition 32*b* from the framework 12**.

Screws 36 or other conventional fasteners secure an edge 38 of the framework 12 to an adjacent wall (not shown). Preferably, the entire perimeter of the framework 12 is an edge 38 fastened to an adjacent wall, but this is omitted for greater clarity in FIG. 1.

Figure 2:
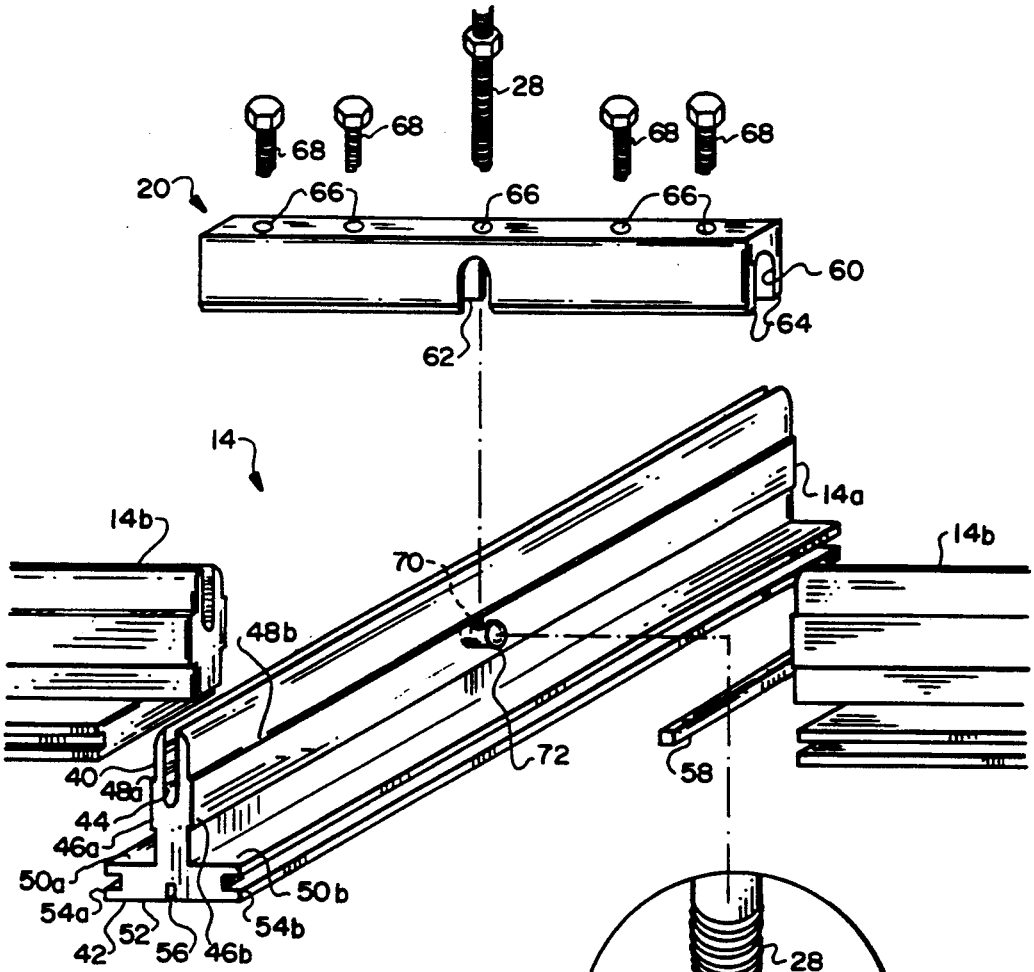
FIG. 2 is an enlarged, partially exploded view of one of the cross intersections of the system shown in FIG. 1.

As best seen in FIG. 2, the frame members 14 have an inverted-T shaped cross-section with a vertical segment 40 and a horizontal segment 42. A Unshaped slot 44, which extends along the length of each of the frame members 14,, is preferably threaded for engaging the lower end of the threaded suspension member 28. The threaded slot 44 is hereinafter referred to as a "screw slot." Shoulders **46*a* and 46*b* extend laterally from the vertical segment 40. Ledges 48*a* and 48*b* are defined, respectively, by the shoulders 46*a* and 46*b*. The horizontal segment 42 provides two bearing surfaces 50*a* and 50*b*, a bottom surface 52 and slotted edges 54*a* and 54*b*. The bottom surface 52 preferably includes a guide groove 56 which extends along the length of the frame member 14**.

The horizontal segment 42 of the crosswise frame members **14*b* is coped at each end to allow the vertical segment 40 of the members 14*b* to abut the vertical segment of the member 14*a* while resting upon the bearing surfaces 50*a* and 50*b*. In this fashion, the coped ends of frame members 14*b* abut the slotted edges 54*a* and 54*b* of frame member 14*a*. Preferably, during assembly a sealant is placed below a shoulder 46 of the member 14*a* where the shoulder abuts the vertical segment 40 of the member 14*b*. Preferably, the ends of other frame members 14 are similarly coped where they form T intersections 39*b* and 39*c*** (FIG. 1).

Preferably, a slot filler 58, shaped for insertion into a slotted edge 54, occupies a portion of the slotted edge of the lengthwise frame member 14 where it abuts a frame member **14*b*. The slot filler 58 is preferably a rigid, slippery, plastic material such as GARLITE® which easily slides into the slotted edge 54. The slot filler 58 thus acts to prevent the passage of air or contaminants laterally along the slotted edges 54**.

The cross splice 20, which secures the member **14*a* to members 14*b* has an inverted U-shaped slot 60 extending along its length and dimensioned to slidably accommodate the upper portion of the vertical segment 40 of the frame members 14*b*. A U-shaped aperture 62, which extends through the width of the cross splice 20, is dimensioned to slidably accommodate the upper portion of the vertical segment 40 of the frame member 14*a*. When assembled, bottom edges 64 of the splice 20 rest on the ledges 48*a* and 48*b*, respectively. Splice 20 preferably includes several through-holes 66. Although the suspension member 28 may be inserted into any through-hole 66, it is preferable to use the centrally located hole 66 for accommodating the suspension member. The other holes 66 are then used to receive bolts 68 which are threaded into the screw slots 44 of the members 14*b*. The holes 66 are preferably located such that when the cross splice 20 is installed on the intersecting frame members 14, the screw slot 44 of each frame member 14** is aligned with at least one hole.

Figure 2A:
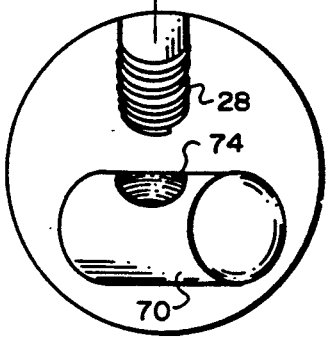
FIG. 2A is an enlarged view of a fastener for attaching a suspension rod to a frame member.
Figure 3A:
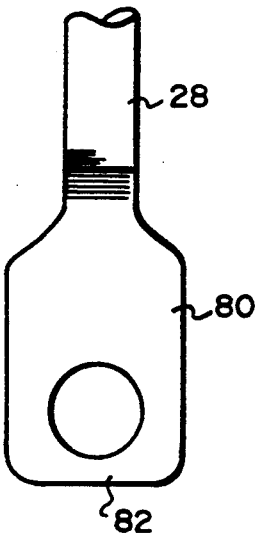
FIGS. 3A-3D show an alternative embodiment of a fastener for attaching a suspension rod to a frame member.
Figure 3B:
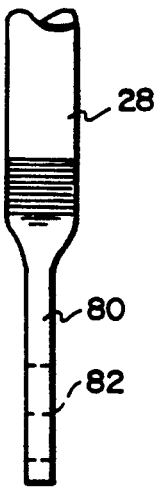
Figure 3C:
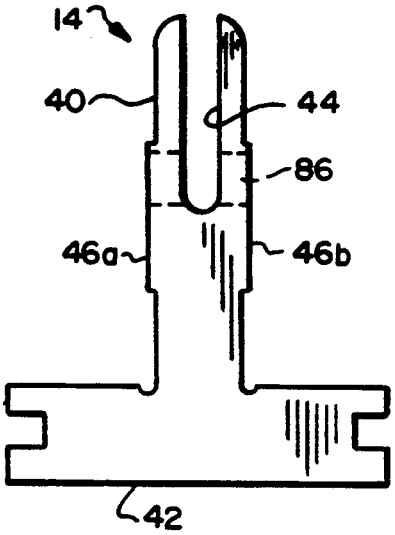
Figure 3D:
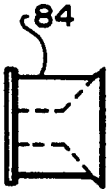

As shown best in FIG. 2A, a fastening member 70, adapted to engage the suspension member 28 may be disposed within the vertical segment 40 of the frame member 14*a*. The fastening member 70 is oriented transverse to the length of the frame member 14 and is disposed in a hole 72 which extends through the width of the vertical segment 40.

In a preferred embodiment of the present invention, the fastening member 70 is a cross dowel nut having a threaded opening 74 which is dimensioned to engage the threaded suspension member 28 when it is threaded into the screw slot 44. It is preferred that the hole 72 be located substantially within the shoulder 46, but at least partially intersecting the bottom of the screw slot 44 so that the suspension member 28 may engage with the threaded opening 74.

The cross dowel nut 70 may be positioned in the above-described manner substantially anywhere along the framework by providing a hole 72 at the desired location. Moreover, the cross dowel nut 70 may be used with or without the cross splice 20.

The use of fastening members, and in particular the cross dowel nut 70, to attach the suspension members 28 to the framework 12 has been found to substantially increase the load-bearing capacity of the ceiling system 10. This is in part attributable to the fact that the cross dowel nut 70 is advantageously oriented transverse to the length of the frame member 14 and is substantially disposed in the solid portion of the vertical segment 40. Thus, the cross dowel nut 70 substantially increases the force required to forcibly part the suspension member 28 from the frame member 14, as compared to simply threading the suspension member into the screw slot 40. In destructive testing performed on a prototype of the present invention, most suspension members 28 secured with the cross dowel nut 70 failed under a load of 3,800–4200 pounds, as compared with less than 1,000 pounds for suspension members which were threaded into the screw slot, but not the cross dowel nut.

Moreover, use of the cross dowel nut 70 provides greater flexibility in the installation of the ceiling system and configuration of the cleanroom. The small size and shape of the cross dowel nut 70 permit it to be placed at practically any desired point along the framework 12. Further, the hole 72 for the cross dowel nut 70 can be drilled as needed on-site. Thus, a suspension member 28 can be repositioned without necessarily compromising the load-bearing capacity of the ceiling system.

As a result of this greatly increased load-bearing capacity, the ceiling system 10 can support all utilities which are conventionally placed in cleanrooms and core areas, as well as air filter modules, light fixtures, blank panels, and the like. This arrangement frees valuable floor space below for use as additional and flexible cleanroom space.

The increased load-bearing capacity of the ceiling system 10, in combination with the stiffness of the members 14, permits a human technician to walk freely on top of the framework 12. Since the members 14 are rigid, the deflection produced by the technician walking on top of the framework is sufficiently small so as not to disrupt the seals between the framework 12 and the supported components 18.

Further, due to its improved load-bearing capacity, the ceiling system 10 may also support equipment such as robotics, process piping and partitions, any of which may generally be suspended anywhere on the framework 12. Such loads need not be aligned with nor attached to a suspension member 28 because the framework 12 itself bears the loads.

The ability of the ceiling system 10 to support all of the core utilities overhead permits easy and low cost reconfiguration of the cleanroom without massive rerouting of the utilities. Thus, the present invention provides enhanced flexibility in the design of the manufacturing or assembly operations conducted within the cleanroom.

FIG. 3 illustrates an alternative arrangement for securing suspension members 28 to the framework 12. In this arrangement, the suspension member 28 includes an integral flattened portion 80. The flattened portion 80 is sufficiently thin that it may be inserted into the screw slot 44 of the frame member 14. A hole 82, which is dimensioned to receive a fastening member 84, extends through the flattened portion 80. A lateral through-hole 86 in the vertical segment 40 of the frame member 14 is preferably positioned so that when the flattened portion 80 is inserted into the screw slot 44, the fastening member 84 may be inserted through the holes 84 and 82. The fastening member 84 is preferably a sex bolt as shown in FIG. 3D. Alternatively, the fastening member 84 may be a different conventional fastener such as a dowel pin (not shown).

Figure 4:
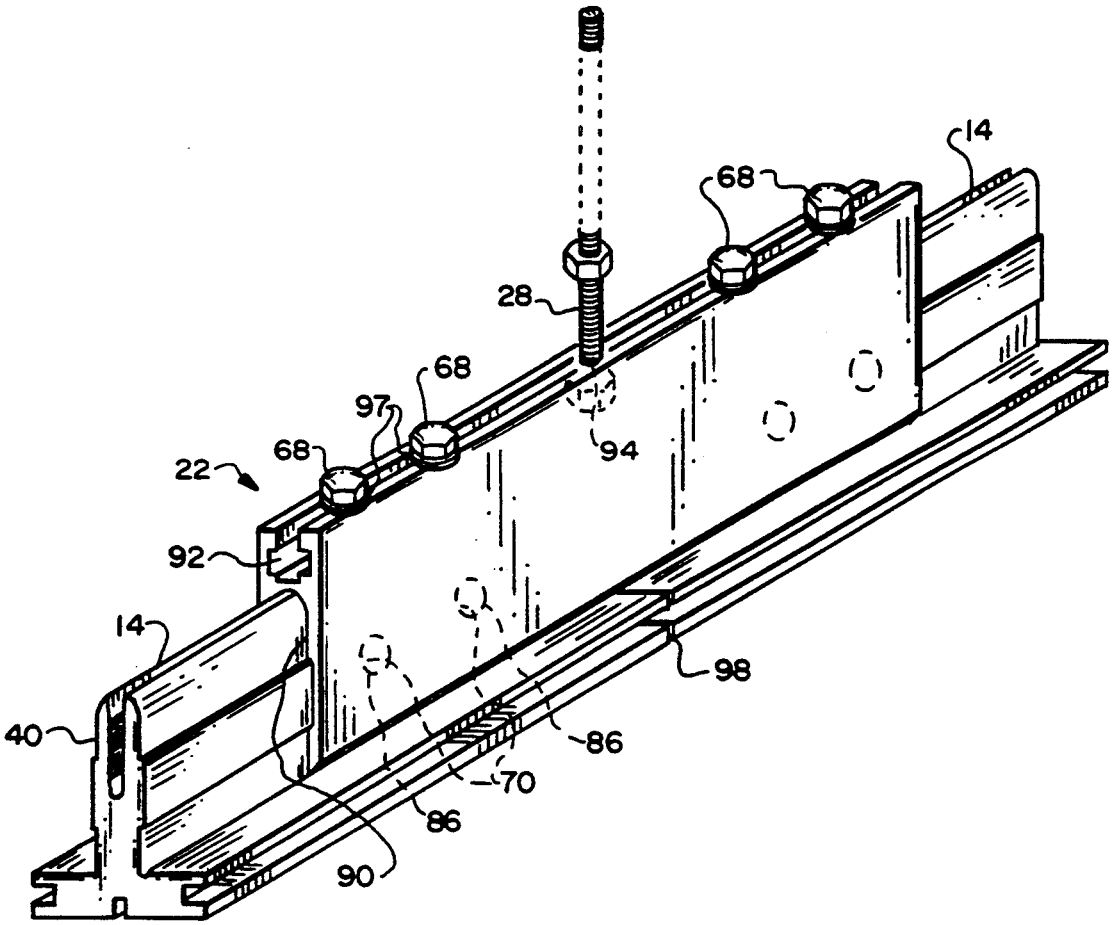
FIG. 4 is an enlarged perspective view of an assembled main splice used to secure two frame members together.

FIG. 4 shows an assembled main splice 22 for connecting two colinear frame members 14. The lower portion of the main splice 22 has a slot 90 which is shaped to slidably accommodate the vertical segment 40 of a frame member 14. A cross-shaped slot 92 extends along the length of top of the splice 22. The slot 92 is shaped such that a nut 94 or other fastener may be disposed in the slot for securing the suspension member 28. The slot 92 is provided because the suspension member 28 does not thread into the seam 98 formed by the two frame members 14. Moreover, the cross dowel nut 70 or other fasteners can not be secured as described above at the seam 98. Where the seam 98 occurs at the preferred location for attaching the suspension member 28, i.e. the center of the splice 22, the slot 92 permits such attachment.

The bottom of the slot 92 has a plurality of through-holes for accommodating bolts 68, preferably in combination with washers 97, which are threaded into the screw slots 44 of the frame members 14. Preferably, when the splice 22 is installed at least one bolt 68 engages the respective screw slot 44 of the two frame members 14. The cross dowel nut 70 can be used in conjunction with the bolts 68 to increase the strength of the splice 22. The through-holes may likewise be used to thread the suspension member 28 into the screw slot 44.

Figure 5A:
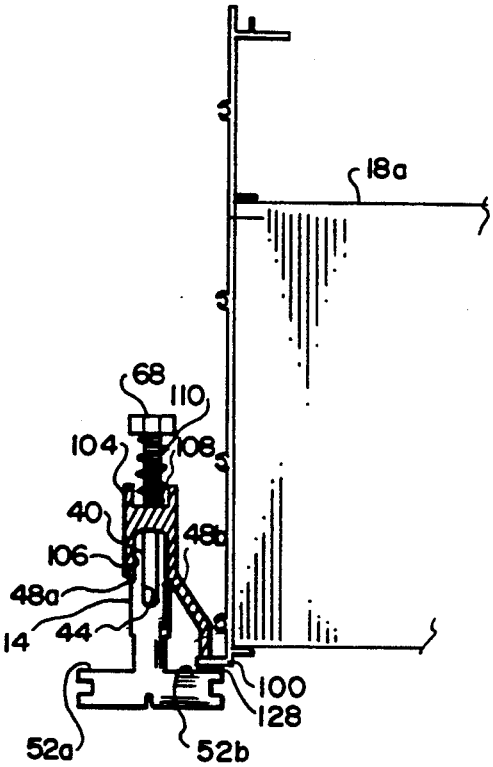
FIGS. 5A-5B depict clamps for securing air filter modules.
Figure 5B:
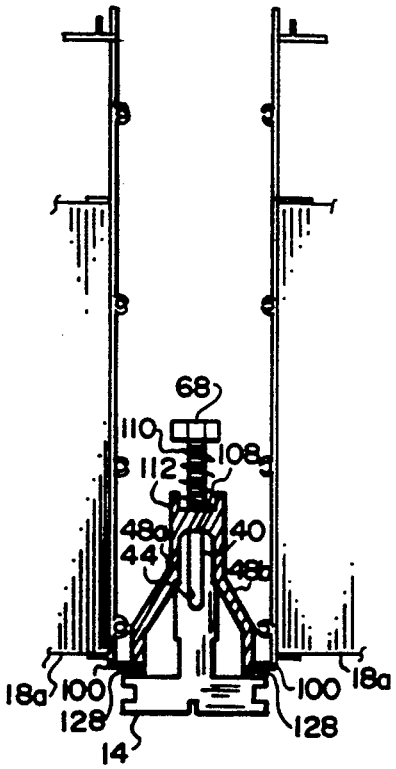

Turning now to FIGS. 5A–5B and 6A–6B, various clamps are shown for securing components such as air filter modules, blank panels and the like to the framework 12. As shown in FIGS. 5A and 5B, the perimeter of an air filter module 18*a* has a laterally-extending flange 100 which supports the module when seated on the framework 12. An air filter clamp 104 is used for securing a module 18*a* to the frame member 14. The clamp 104 has an inverted U-shaped slot 106 which is dimensioned to slidably engage the upper portion of the vertical segment 40 of the frame member 14 and seat against the ledges 48*a* and 48*b*. The clamp 104 has a through hole 108 in which a bolt 68 and spring 110 are disposed. The bolt 68 engages the screw slot 44 and, in combination with the spring 110, causes downward pressure to be exerted on the flange 100. Typically, some type of conventional sealant 128 is located on the bearing surfaces 52 to form an air-tight seal between the bearing surfaces and the air filter module 18*a* disposed thereon.

FIG. 5B, shows an air filter clamp 112 which is similar to clamp 104, except that it may be used to secure two adjacent modules 18*a* to opposite sides of a single frame member 14.

Figure 6A:
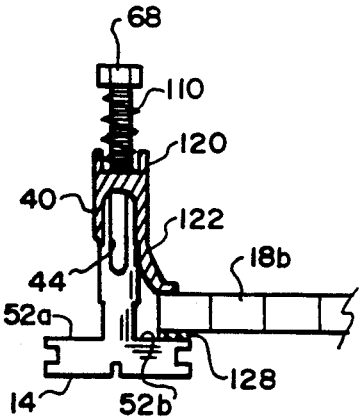
FIGS. 6A-6B depict clamps for securing blank panels.

With reference now to FIG. 6A, a blank panel clamp 120 for securing a blank panel 18*b* to one side of a frame member 14 is shown. Similar to the air filter clamps 104 and 112, the clamp 120 is adapted to slidably engage the vertical segment 40 such that the clamp 120 abuts the ledges 48 and bears downward against the upper surface of the blank panel 18*b*. Preferably, the clamp 120 has a leg 122 which extends downward and bears upon the upper surface of the blank panel 18*b*. As with the air filter clamps 104 and 112, sealant 128 is typically located on the bearing surfaces 52 to form an air-tight seal between the bearing surfaces and the blank panel 18*b*.

Figure 6B:
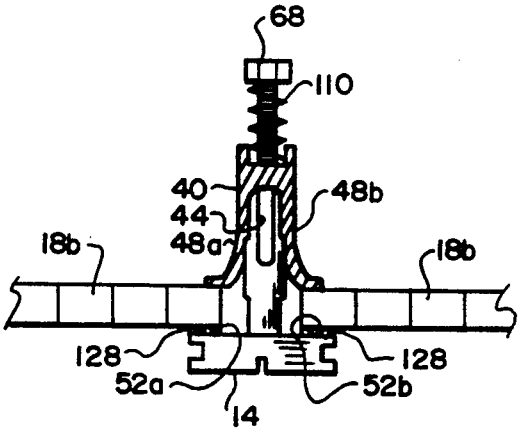

FIG. 6B shows an blank panel clamp 130, which is similar to clamp 120, for securing two adjacent blank panels 18*b* to opposite sides of a single frame member 14.

Figure 7A:
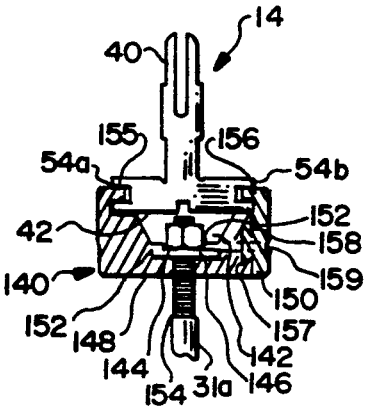
FIGS. 7A-7E illustrate various clips for suspending loads from the system shown in FIG. 1.

FIGS. 7A–7D depict various clips which cooperate with the frame members 14 and, possibly, the load suspension members 31*a* or 31*b* (FIG. 1) to suspend loads such as pipes 32*a* from the framework 12. As best seen in FIG. 7A, a clip 140 engages the slotted edges 54*a* and 54*b* of a frame member 14. The clip 140 has a hollow interior 142 which advantageously provides clearance for a nut 144 and a washer 146 when the clip 140 is secured to the frame member 14. Preferably, the clip 140 is formed from two interlocking members 148 and 150. Each member 148, 150 includes an integral flange 152 which extends inwardly from each side of the interior 142 to restrict the upward movement of the washer 146. Member 148 has a hole 154 dimensioned to receive load suspension member 31*a*. Each member 148 and 150 has an integral flange 155 and 156, respectively, for engaging one of the slotted edges 54*a* or 54*b*. Member 148 has a slot 157 adapted to receive a dovetail flange 158 of member 150. Although the dovetail connection alone will secure the two sections 148 and 150 together, a screw 159 or any other conventional fastener may be inserted laterally through the dovetail flange 158 to further secure the two sections together.

Figure 7E:
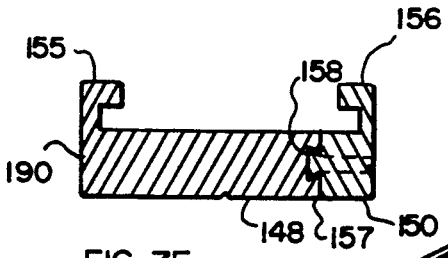
Figure 7B:
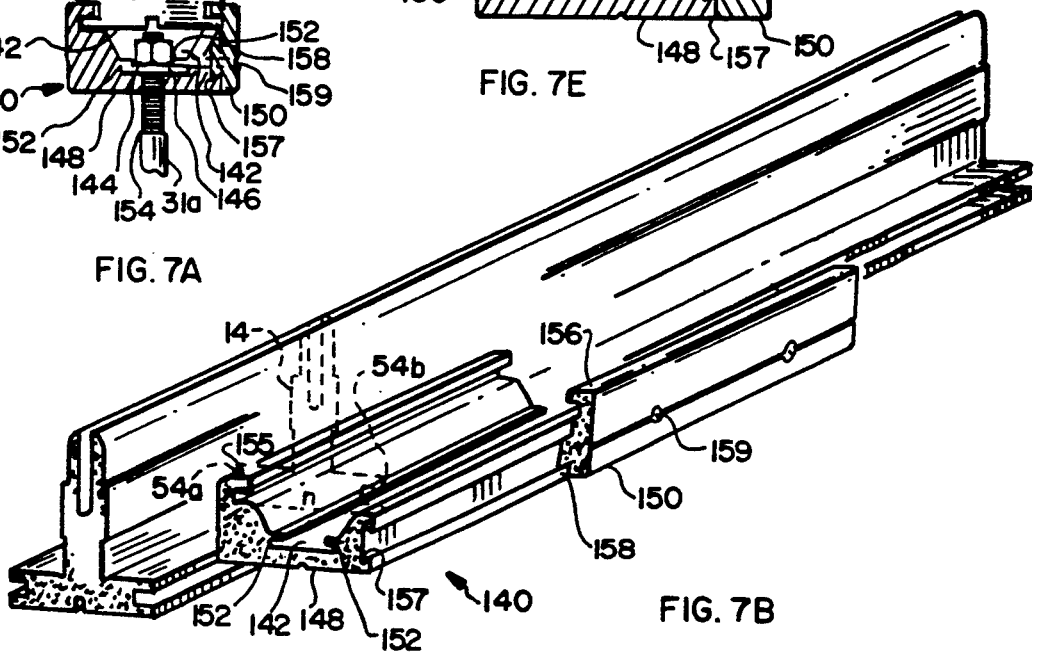

FIG. 7B is a perspective view of the clip 140 attached to a frame member 14. In this figure, the flanges 155 and 156 engage the slotted edges 54*a* and 54*b*, respectively. The dovetail flange 158 interlocks with the slot 157. The two members 148 and 150 are then slidably aligned with each other.

Figure 7C:
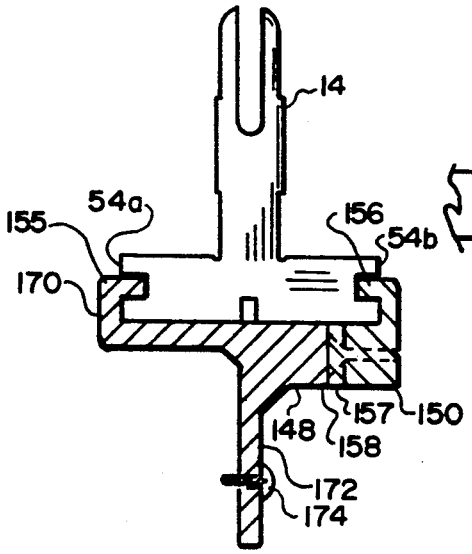

FIG. 7C shows a clip 170 for securing a surface mount-type light fixture (shown in phantom). The clip 170 engages the slotted edges 54*a* and 54*b* of the frame member 14 in a fashion substantially similar to that described above in connection with FIG. 7A. A downward projecting arm 172 provides a suitable vertical mounting surface to which the light fixture may be attached by screws 174 or other conventional fasteners.

Figure 7D:
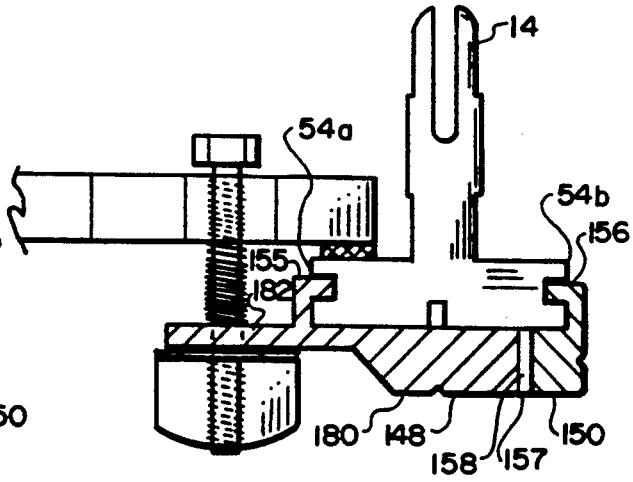

FIG. 7D shows a clip 180 for securing a blank panel or filter requiring access from below. The clip 180 engages the slotted edges 54*a* and 54*b* of the frame member 14 in a manner substantially similar to that described above in connection with FIG. 7A. An outwardly protruding horizontal leg 182 provides a clamping mechanism to seat the blank panel or filter and allows access from the room below.

FIG. 7E shows a clip 190 for securing a substantially heavy load from the framework 12. The clip 190 engages the slotted edges 54*a* and 54*b* of the frame member 14 in a fashion substantially similar to that described above in connection with FIG. 7A. Unlike clip 140, however, clip 190 does not have a hollow interior 142. Preferably, the load suspension members are screwed into the bottom of the clip 190.

Each of the clips 140, 170, 180, and 190 may be positioned at substantially any location along a frame member 14, either at the time of installation or subsequently.

Figure 8:
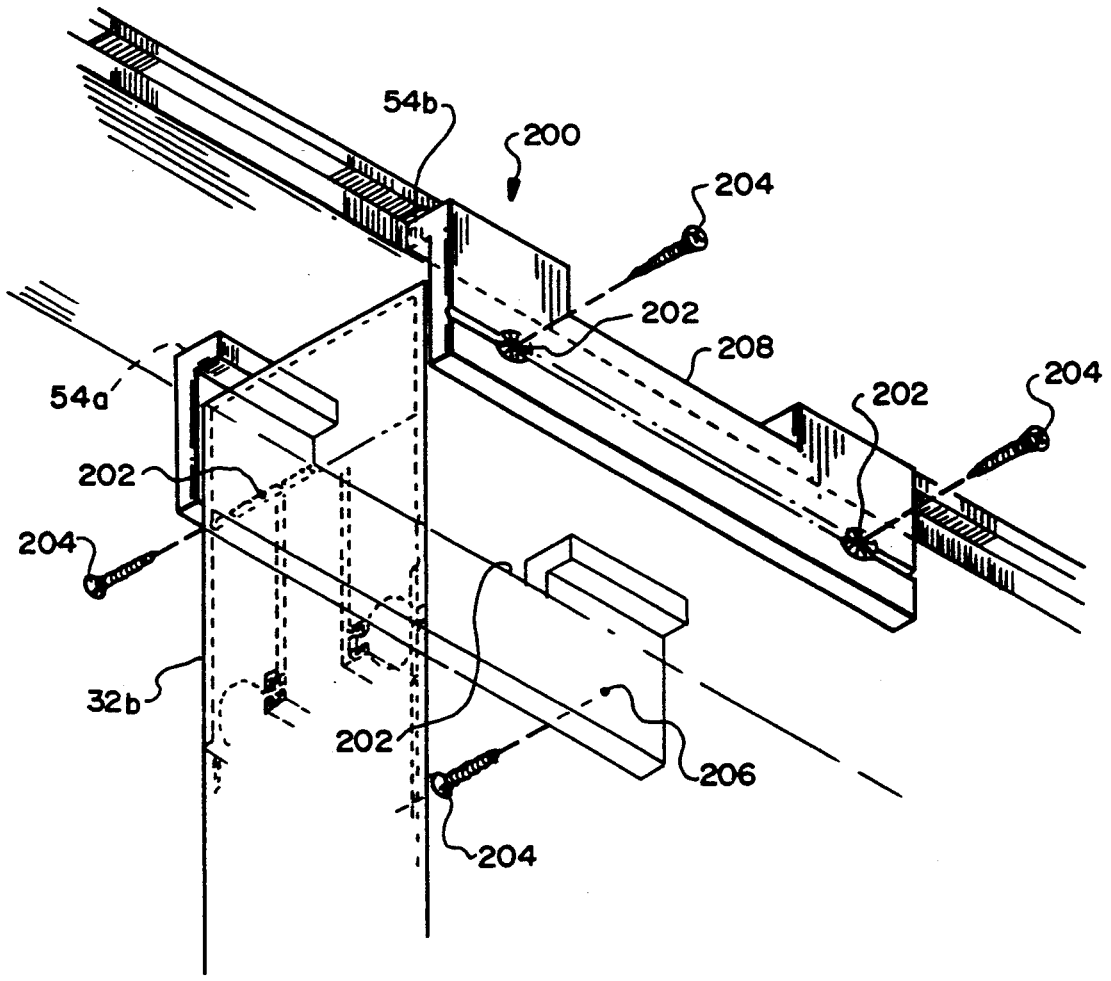
FIG. 8 is a perspective view of a partition clip for suspending a wall partition from the system shown in FIG. 1.

FIG. 8 shows a two-piece partition clip 200 for securing a wall partition 32*b* (shown here in phantom for enhanced clarity) to the framework 12. The clip 200 is adapted to engage the slotted edges 54 of the frame member 14. Each piece of the clip 200 has holes 202 through which screws 204 are inserted to secure the wall partition 32*b*. Recesses 206 and 208 are provided to accommodate a crosswise frame member 14*b*.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A suspended ceiling system comprising:

a plurality of frame members arranged to form a load-bearing framework, each of said members having a cross-section comprising a solid vertical portion and a solid horizontal portion in an inverted T-shape, the upper end of said vertical portion including a slot whose sides are threaded and which extends along the length of the member;

a plurality of threaded rods for suspending the framework from a structure; and cross dowel nuts disposed in said vertical portions, oriented transverse to the lengths of the frame members and extending through walls defining the slots, said rods extending vertically through said slots and threadedly engaging said cross dowel nuts.

2. The system as in claim 1 wherein said horizontal portion provides a load-bearing surface on either side of the vertical portion and includes slotted edges which are adapted for suspending loads from the framework.

3. The system as in claim 2 further comprising a load-bearing clip formed from first and second sections each having an integral flange for engaging a respective one of the slotted edges, and including means for interlocking said first and second sections.

4. The system as in claim 3 wherein the interlocking means is a dovetail-shaped flange and matching slot.

5. The system as in claim 2 further comprising a clamp adapted for engagement with said threaded slot, said clamp providing a compressive force upon an object disposed on one of said bearing surfaces.

6. The system as in claim 5 wherein the object is an air filter module and the clamp includes a leg shaped to bear downwardly on the perimeter of the module.

7. The system as in claim 5 wherein the object is a blank panel and the clamp includes a leg shaped to bear downwardly on the blank panel.

8. The system as in claim 2 wherein one or more of said bearing surfaces is covered with a sealing material, whereby an airtight seal is provided between said surfaces and objects disposed thereon.

9. A suspended ceiling system comprising:

a plurality of frame members arranged to form a load-bearing framework, each of said members having a vertical slot extending along its length;

a plurality of threaded rods for suspending the framework from a structure, each of said threaded rods adapted for insertion into said slot; and cross dowel nuts disposed in said vertical portions, oriented transverse to the lengths of the frame members and extending through walls defining the slots, said rods extending vertically through said slots and threadedly engaging said cross dowel nuts.

10. The system as in claim 9 further comprising a load-bearing clip formed from first and second sections, said clip adapted for engaging the frame member, and including means for interlocking said first and second sections.

11. A suspended ceiling system comprising:

a plurality of frame members arranged to form a load-bearing framework, each of said members having a cross-section comprising a solid vertical portion and a solid horizontal portion in an inverted T-shape, the upper end of said vertical portion including a slot whose sides are threaded and which extends along the length of the member;

a plurality of rods for suspending the framework from a structure;

cross dowel nuts disposed in said vertical portions, oriented transverse to the lengths of the frame members and extending through the walls defining the slots, said rods extending vertically down into said slots and fastened to said cross dowels;

a load-bearing clip formed from first and second sections, said clip adapted for engaging one of the frame members, and including means for interlocking said first and second sections; and a plurality of splice members adapted for connecting said frame members together and permitting the suspension members to engage said frame members.

12. A suspended ceiling system comprising:

a plurality of frame members arranged to form a load-bearing framework, each of said members having a cross-section comprising a solid vertical portion and a solid horizontal portion in an inverted T-shape, the upper end of said vertical portion including a slot whose sides are threaded and which extends along the length of the member;

a plurality of threaded rods for suspending said framework from a structure;

said rods threadedly engaging the sides of said slot.

13. A suspended ceiling system comprising:

a plurality of frame members arranged to form a load-bearing framework, each of said members having a cross-section comprising a solid vertical portion and a solid horizontal portion in an inverted T-shape, the upper end of said vertical portion including a slot whose sides are threaded and which extends along the length of the member;

a plurality of rods for suspending the framework from a structure;

cross dowel nuts disposed in said vertical portions, oriented transverse to the lengths of the frame members and extending through the walls defining the slots, said rods extending vertically down into said slots and threadedly fastened to said cross dowel nuts; and a plurality of splice members adapted for connecting said frame members together and permitting the suspension members to engage said frame members.

14. A suspended ceiling system comprising:

a plurality of frame members arranged to form a load-bearing framework, each of said members having a cross-section comprising a solid vertical portion and a solid horizontal portion in an inverted T-shape, the upper end of said vertical portion including a slot whose sides are threaded and which extends along the length of the member;

a plurality of suspension members for suspending the framework from a structure;

fastening means for securing one of the suspension members to the framework, said fastening means being disposed within the vertical portion of one of the frame members, whereby said one of the suspension members may be inserted into said slot and engaged with said fastening means; and a load-bearing clip formed from first and second sections, said clip adapted for engaging one of the frame members, and including means for interlocking said first and second sections, said interlocking means being a dovetail-shaped flange and a matching slot.

* * * * *